US005518494A

United States Patent [19]

Borgström et al.

[11] Patent Number: 5,518,494

[45] Date of Patent: May 21, 1996

[54] CENTRIFUGAL SEPARATOR WITH AIR ENTRAINMENT SUPPRESSION

[75] Inventors: Leonard Borgström, Egilsvägen; Claes-Göran Carlsson, Skogshemsvägen; Peter Franzén, Månstorpsvägen; Claes Inge, Kristinavägen; Torgny Lagerstedt, Döbelnsgatan; Hans Moberg, Björngårdsgatan, all of Sweden

[73] Assignee: Alfa Laval Separation AB, Tumba, Sweden

[21] Appl. No.: 495,306

[22] Filed: Jun. 27, 1995

Related U.S. Application Data

[63] Continuation of Ser. No. 232,046, filed as PCT/SE93/00845, Oct. 15, 1993, abandoned.

[30] Foreign Application Priority Data

Oct. 19, 1992 [SE] Sweden ..... 9203056

[51] Int. Cl.[6] ..... B04B 1/08; B04B 11/08

[52] U.S. Cl. ..... 494/56; 494/70

[58] Field of Search ..... 494/56, 65, 68, 494/70, 74, 79; 210/380.1

[56] References Cited

U.S. PATENT DOCUMENTS

| | | | |
|---|---|---|---|
| 872,173 | 11/1907 | Forsberg . | |
| 1,887,476 | 11/1932 | Lindgren | 494/70 X |
| 2,125,453 | 8/1938 | Lindgren . | |
| 2,612,356 | 9/1952 | Borck | 494/79 X |
| 2,823,853 | 2/1958 | Hoffmann | 494/70 X |
| 2,910,226 | 10/1959 | Thylefors | 494/79 X |
| 3,317,126 | 5/1967 | Little et al. | 494/74 X |
| 4,406,652 | 9/1983 | Nielsen | 494/56 |
| 4,698,053 | 10/1987 | Stroucken | 494/70 |
| 5,024,648 | 6/1991 | Inge et al. | 494/56 |

FOREIGN PATENT DOCUMENTS

| | | | |
|---|---|---|---|
| 176539 | 10/1906 | Germany . | |
| 93677 | 12/1938 | Sweden . | |
| 156097 | 7/1932 | Switzerland . | |
| 292127 | 11/1928 | United Kingdom | 494/56 |

*Primary Examiner*—Charles E. Cooley
*Attorney, Agent, or Firm*—Fish & Richardson

[57] ABSTRACT

A centrifugal separator has a rotor, which forms an inlet chamber, a separation chamber (5) and an outlet chamber (10), in which a liquid, separated during operation, forms a rotating liquid body with a radially inwardly directed free liquid surface. A stationary discharge device (17) is provided together with rods 20 which are arranged to entrain, during the operation of the rotor, the liquid present in the outlet chamber (10) and to admit flow of such liquid radially outwardly to an inlet (19) in the discharge device (17). The rods are distributed around the rotational axis and rotate with the rotor and form flow spaces which extend axially, radially and in the circumferential direction. They entrain the liquid in the outlet chamber (10) efficiently and to admit flow of the liquid radially outwardly to the inlet (19) with reduced risk of air admixture. A wing extending radially and axially in the outlet chamber may also be provided.

7 Claims, 2 Drawing Sheets

CENTRIFUGAL SEPARATOR WITH AIR ENTRAINMENT SUPPRESSION

This is a continuation of application Ser. No. 08/232,046 filed on Apr. 25, 1994, now abandoned International Application PCT/SE93/00845 filed on 15 Oct. 1993 and which designated the U.S.

FIELD OF THE INVENTION

The present invention relates to a centrifugal separator with means to suppress air entrainment.

The present invention concerns a centrifugal separator comprising a rotor, which has an inlet chamber for liquid mixture of components, a separation chamber connected to the inlet chamber, an outlet chamber, connected by a passage to the separation chamber, for receiving a liquid separated in the separation chamber during operation, in the separation chamber, and which is so designed that, during operation liquid present therein during operation forms a rotating liquid body with a radially inwardly directed free liquid surface. The centrifugal separator also comprises a stationary discharge device, which from the said liquid body extends radially inwards to a central outlet, and in which at least one outlet channel is formed, one end of which has an inlet located in said liquid body, and the other end of which opens into an outlet connected to the discharge device. Furthermore, the centrifugal separator comprises means connected to the rotor, which are arranged to entrain the separated liquid present in the outlet chamber in the rotation of the rotor during operation of the rotor and at the same time admit flow of such liquid in the outlet chamber radially outwards to the inlet of the outlet channel.

BACKGROUND OF THE INVENTION

In a known centrifugal separator of this kind the passage from the separation chamber opens into the outlet chamber at a level radially inside the free liquid surface. In the outlet chamber a number of wings extending axially and radially are fixed to the walls defining of the outlet chamber. A separated liquid entering the outlet chamber is thrown radially outwardly and collides either directly with the free liquid surface or with one of said wings thereafter to be thrown further radially outwardly to the free liquid surface. The flow of the separated liquid radially outwardly in the rotating liquid body to the inlet of the outlet channel mainly takes place in thin layers along the wings and one of the end walls of the outlet chamber.

The described collision between the separated liquid and the free liquid surface, or between the liquid and a wing, result in splashes, which means there is a great risk of air or gas, located radially inside the free liquid surface in the outlet chamber, being admixed in the separated liquid, which flows radially outwardly to the inlet of the outlet channel and then to the outlet. Also the locally high liquid flow velocity, which occurs in the layers of the liquid body the free liquid surface, in which the liquid flows radially outwardly, results in a great risk of such an admixture of air or gas.

In order to decrease the high liquid flow velocities in the layers in which the liquid flows radially outwardly it has been suggested, as shown in WO 89/03250 A1, that the means, which in the outlet chamber is to entrain the liquid into the rotation of the rotor, is designed as at least one disk concentrically fixed to the rotor. By this means, the outwardly directed liquid flow in the outlet chamber is distributed in more layers having a large total cross-sectional area, whereby the flow velocities in the layers and consequently the risk of air admixture decreases. However, the disc or discs according to this suggested solution is not capable of decreasing the air admixture sufficiently and at at the same time satisfactorily entraining the separated liquid in the rotation of the rotor.

SUMMARY OF THE INVENTION

An object of the present invention is to provide a centrifugal separator of the kind described, in which the risk of air admixture in a discharge separated liquid to be discharged is less than in hitherto known centrifugal separators of this kind with a corresponding capability entraining the separated liquid in the outlet chamber.

This object is accomplished, according to the present invention by the fact that the means to entrain the separated liquid present in the outlet chamber during operation of the rotor comprises several elongated elements distributed around the rotational axis and rotating with the rotor which elements between themselves, form flow spaces, which extend axially, radially and in a circumferential direction of the rotor.

In a preferred embodiment of the invention the elongated elements are straight and regularly oriented in an essential axial direction but they can alternatively be directed radially.

In another embodiment of the invention the elongated elements are irregularly oriented and advantageously abut with against each other.

In a special embodiment of the invention the elongated elements can be supplemented by at least one wing fixedly connected to the rotor, the wing extending radially and axially in the outlet chamber, in such a way that an efficient entrainment of the liquid in the outlet chamber is obtained.

BRIEF DESCRIPTION OF THE DRAWINGS

The invention will be more fully described with reference to the accompanying drawings in which.

DESCRIPTION OF THE PREFERRED EMBODIMENTS

Figure 1:
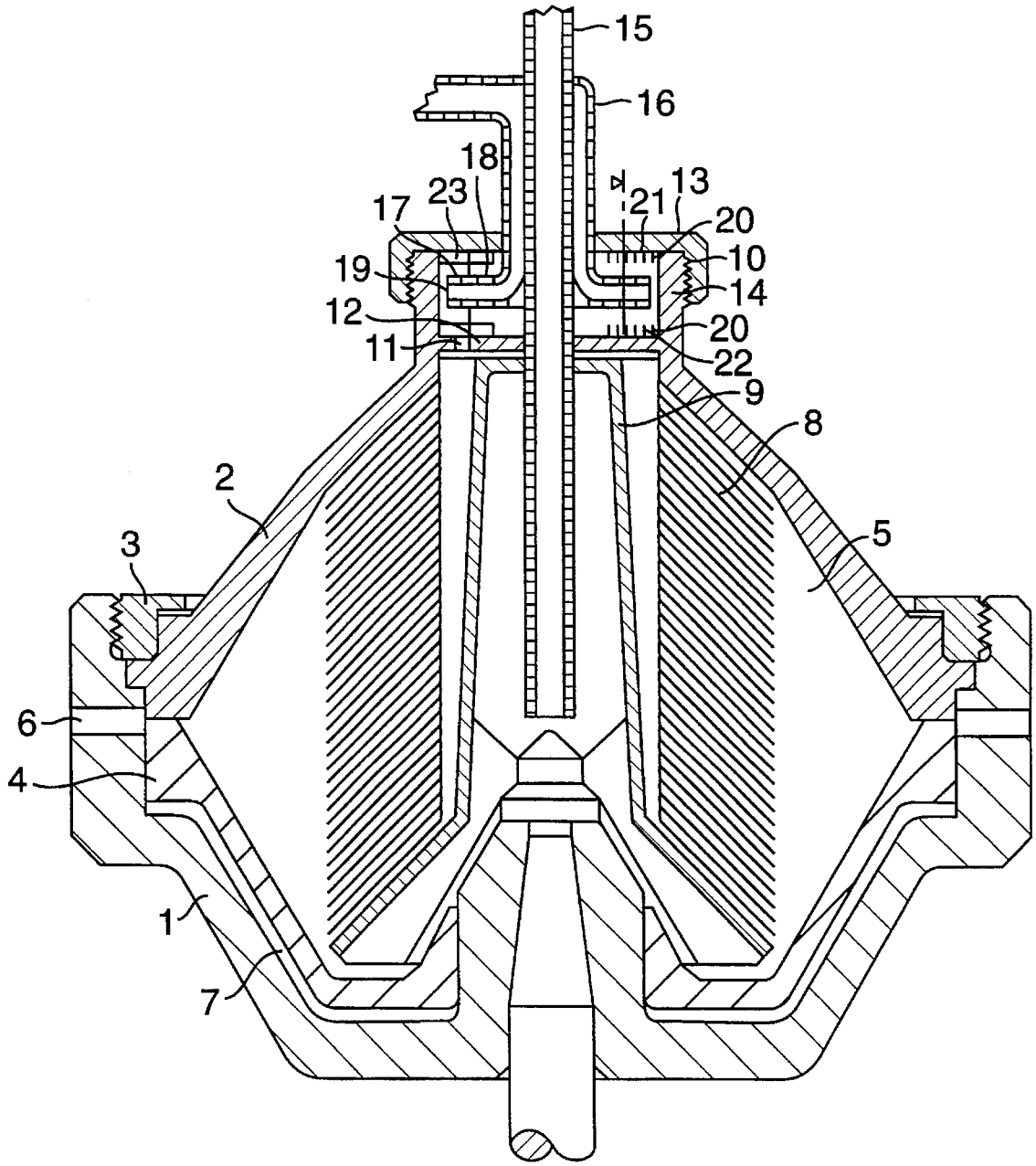
FIG. 1 schematically shows an axial section through a part of a centrifugal separator according to the invention.

The part of a centrifugal separator shown in FIG. 1 comprises a rotor, which has a lower part 1 and an upper part 2, joined together by a locking ring 3. Inside the rotor an axially movable valve slide 4 is arranged. This valve slide defines with the upper part 2, a separation chamber 5 and is arranged to open and close an outlet passage between the separation chamber 5 and outlet openings 6 to release, intermittently, a component which has been separated from a mixture supplied to the rotor and has been accumulated at the periphery of the separation chamber. The valve slide 4 defines together with the lower part 1 a closing chamber 7, which is provided with an inlet and a throttled outlet for a closing liquid. These inlets and outlets are not shown in the drawings.

Inside the separation chamber 5 a disc stack 8 consisting of a number of conical separation discs is arranged between a distributor 9 and the upper part 2. The upper part 2 forms in the figure shown, in its upper end an outlet chamber 10, to which a specific lighter liquid separated during operation from a mixture supplied to the rotor can flow from the separation chamber 5 via a passage 11 and in the outlet chamber 10 form a rotating liquid body with a radially inwardly directed free liquid surface at a certain radial level. The outlet chamber 10 is defined by two axial end walls 12, 13 and a circumferential wall 14, which extends between the end walls.

A stationary inlet tube 15, which opens in the interior of the distributor 9 arranged centrally in the outlet chamber 10. Around this inlet tube 15 a stationary outlet tube 16 is arranged for the specific lighter liquid in the supplied mixture. The outlet tube 16 extends into the outlet chamber 10. Inside the outlet chamber 10 a stationary discharge device 17 is arranged around the inlet tube 15. The discharge device 17 extends from the rotational liquid body radially inwardly to the inlet tube 15 and contains within itself at least one outlet channel 18, one end of which has a peripheral inlet 19, and the other end of which opens in the interior of the outlet tube 16.

In the outlet chamber 18 means 20 are arranged fixedly connected to the end walls 12 and 13. These means 20 are arranged to entrain the liquid present in the outlet chamber 10 during operation in the rotation of the rotor and the same permit the liquid to flow radially outwardly to the inlet 19 of the outlet channel 18.

Figure 2:
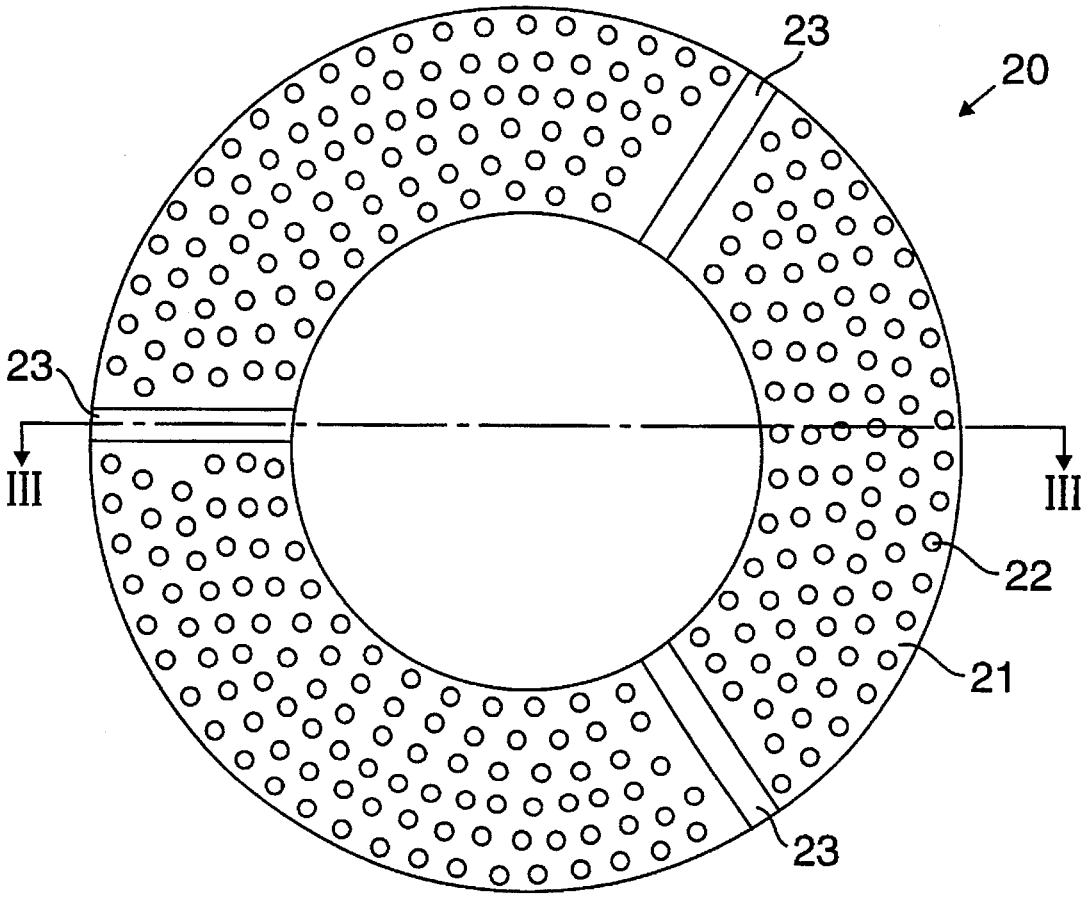
FIG. 2 shows a view of a detail in a centrifugal separator according to the invention.
Figure 3:
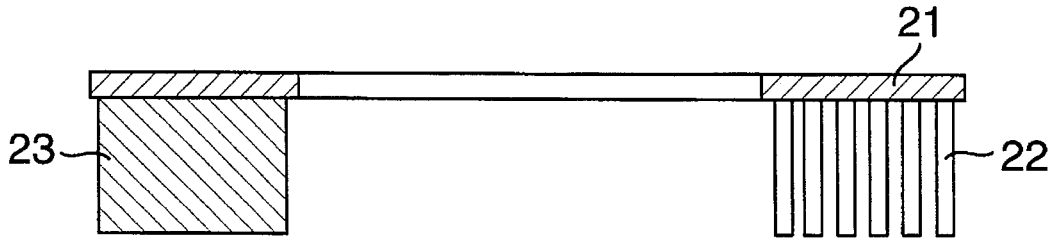
FIG. 3 shows a section along the line III—III in FIG. 2.

FIG. 2 and 3 show more in detail the design of said means 20. According to this embodiment of the invention the means 20 comprise an annular circular disc 21, which is fixedly connected to an end wall 12 or 13 concentric with the rotational axis. On the axial side of the disc, which is directed towards the stationary discharge device 17 several elongated elements 22 are distributed around the rotational axis and form between themselves flow spaces, which extend axially, radially and in the circumferential direction of the rotor. In the embodiment shown the elongated elements 22 are rods fixedly connected to each other via the disc 21 and extend axially and essentially normally to the axial end walls 12 and 13. The flow spaces between the elongated elements 22 are open in the direction toward the stationary discharge device 17.

In order to increase the entraining capability of the means, the means 20 shown as an example also comprises three wings 23 fixedly connected to the disc 21, which extends radially and axially in the outlet chamber 10.

A centrifugal separator which is designed according to the invention works in the following manner:

Upon start of the centrifugal separator the rotor is brought to rotate and the separation chamber 5 is closed by supplying a closing liquid to the closing chamber 7 through an inlet (not shown). After the separation chamber 5 has been closed the liquid mixture which is to be centrifugally treated, is supplied to the separation chamber 5 through the inlet tube 15 and the distributor 9. Gradually the separation chamber 5 is filled up, the rotor reaches the rotational operating speed and conditions are stabilized inside the separation chamber. The components contained in the liquid mixture are separated under the influence of the centrifugal forces acting on them.

The separation mainly takes place in the interspaces spaces between the conical discs in the disc stack 8. During separation the specific heavier component is thrown radially outwardly and is accumulated in the radially outermost part of the separation chamber, whereas the specific lighter liquid flows radially inwardly in these interspaces.

The specific heavier component is intermittently discharged during operation by operating the valve slide 4 periodically to uncover the peripheral outlet openings 6.

The specific lighter liquid flows out through the separation chamber 5 through the passage 11 to the outlet chamber 10, in which it forms a rotating liquid body with a radially inwardly directed free liquid surface. The liquid present in the outlet chamber 10 is discharged through the outlet channel 18 in the stationary discharge device 17 via its inlet 19. The entrainment of the liquid present in the outlet chamber 10 takes place gently by the means 20 rotating with the to tot and by other internal surfaces of the walls of the outlet chamber. The liquid located closest to the discharge device 17 is slowed down by the contact with the external surfaces of the discharge device 17. By this means, different parts of the liquid located in the outlet chamber 10 will obtain different rotational speeds. The contact between the liquid and the external surfaces of the discharge device 17 results in a circulating flow being generated in the outlet chamber 10, the liquid flowing radially inwardly along the external surfaces of the discharge device 17 and radially outwardly in layers which extend along and connect the elongated elements 22, and along internal surfaces of the walls of the outlet chamber 10. In the case where the means also comprises a wing, liquid also flows radially outwardly in layers along the wing.

This flow radially outwardly is distributed over relatively large layers. By this means the local maximum flow velocities can be kept low, which is especially important at the free liquid surface as the risk of air admixture is especially high there.

If the passage 11 is arranged at essentially the same radius as the radius at which the inlet 19 of the outlet channel 18 is located, the radial outwardly directed flow is to be referred to the internal circulation in the outlet chamber 10.

However, sometimes it is necessary to place the passage 11 radially inside said inlet 19 in order to be able to keep the different liquid levels inside the separation chamber 5 at desired radii. Then the radially outwards directed flow which this location of the passage 11 gives rise to, is added.

What is claimed:

1. In a centrifugal separator comprising a rotor having a rotational axis, a separation chamber, an inlet for furnishing a liquid mixture to be separated to said separation chamber, an outlet chamber having two axial end walls and a circumferential wall, a passage connecting said outlet chamber to said separation chamber for furnishing a liquid separated during operation to said outlet chamber, said outlet chamber being constructed so that liquid present therein during operation forms a rotating body having a free liquid surface facing radially inwardly with respect to said rotational axis, a central outlet, a stationary discharge device extending radially inwardly, with respect to said rotational axis, to said central outlet and having an outlet channel with an open end in said liquid body, the improvement which comprises a plurality of elongated entrainment elements connected to said rotor in said outlet chamber, said elements extending essentially normally from at least one of said axial end walls and spaced from said circumferential wall, said elements having a length substantially greater than their thickness and being positioned with their long dimension extending in the same general direction as the rotational axis, said elements defining flow spaces extending radially, axially and circumferentially relative to the rotational axis.

2. In a centrifugal separator comprising a rotor having a rotational axis, a separation chamber, an inlet for furnishing a liquid mixture to be separated to said separation chamber, an outlet chamber having two axial end walls and a circumferential wall, a passage connecting said outlet chamber to said separation chamber for furnishing a liquid separated during operation to said outlet chamber, said outlet chamber being constructed so that liquid present therein during operation forms a rotating body having a free liquid surface facing radially inwardly with respect to said rotational axis, a central outlet, a stationary discharge device extending radially inwardly, with respect to said rotational axis, to said central outlet and having an outlet channel with an open end in said liquid body, the improvement which comprises a plurality of rods connected to said rotor in said outlet chamber, said rods extending essentially normally from at least one said axial end walls, being spaced from said circumferential wall and having a length substantially greater than their thickness, said rods defining flow spaces extending between one another extending radially, axially and circumferentially relative to the rotational axis.

3. A centrifugal separator according to claim 2, characterized in that at least some of the rods are essentially axially oriented.

4. A centrifugal separator according to claim 2, characterized in that said flow spaces are open in a direction toward the stationary discharge device (17).

5. A centrifugal separator according to claim 2 wherein said rods are connected to each other by at least one of said axial end walls.

6. A centrifugal separator according to claim 2 wherein the rods are straight and essentially regularly oriented.

7. A centrifugal separator according to claim 2 and comprising at least one wing fixedly connected to the rotor and extending radially and axially relative to the rotational axis in the outlet chamber.

* * * * *

UNITED STATES PATENT AND TRADEMARK OFFICE

CERTIFICATE OF CORRECTION

PATENT NO. : 5,518,494

DATED : May 21, 1996

INVENTOR(S) : LEONARD BORGSTRÖM, CLAES-GÖRAN CARLSSON, PETER FRANZÈN, CLAES INGE, TORGNY LAGERSTEDT AND HANS MOBERG

It is certified that error appears in the above-identified patent and that said Letters Patent is hereby corrected as shown below:

Col. 1, line 24 Cancel "inwards" and substitute --inwardly--

Col. 2, line 29 Cancel "with"

Col. 3, line 10 Before "arranged" insert --is--

Col. 4, line 9 Cancel "to tot" and substitute --rotor--

Col. 5, line 11 (claim 2) after "one" insert --of--

Signed and Sealed this

Sixth Day of May, 1997

Bruce Lehman

*Attest:*

BRUCE LEHMAN

*Attesting Officer*

*Commissioner of Patents and Trademarks*